US012643710B1

(12) United States Patent
Rosa

(10) Patent No.: US 12,643,710 B1
(45) Date of Patent: Jun. 2, 2026

(54) TIRE INTERCONNECT ADAPTER AND SYSTEM

(71) Applicant: Carlos Rosa, Camuy, PR (US)

(72) Inventor: Carlos Rosa, Camuy, PR (US)

( * ) Notice: Subject to any disclaimer, the term of this patent is extended or adjusted under 35 U.S.C. 154(b) by 0 days.

(21) Appl. No.: 19/022,716

(22) Filed: Jan. 15, 2025

Related U.S. Application Data

(62) Division of application No. 18/136,900, filed on Apr. 20, 2023.

(51) Int. Cl.
*B65D 13/00* (2006.01)

(52) U.S. Cl.
CPC ..... *B65D 13/00* (2013.01); *B65D 2209/00* (2013.01); *B65D 2251/20* (2013.01)

(58) Field of Classification Search
CPC ..... B65D 21/083; B65D 81/3205; B65D 2251/20; B65D 2209/00; B65D 13/00; B60B 25/22; B60B 30/02
USPC ..... 220/4.12
See application file for complete search history.

(56) References Cited

U.S. PATENT DOCUMENTS

2012/0091131 A1* 4/2012 Arjomand ..... B65D 7/22 220/4.01

* cited by examiner

*Primary Examiner* — Anthony D Stashick
*Assistant Examiner* — Lauren Kmet
(74) *Attorney, Agent, or Firm* — Luis Figarella

(57) ABSTRACT

A tire interconnect adapter mechanism for securely coupling two tires (used or new) into a continuous structure in both mechanical terms (either horizontally, vertically or any other suitable angle) as well as in pneumatic/hydraulic terms So that through the successive connection of tires, a water or other suitable fluid tank may be created. In other applications, animal shelters may also be created.

3 Claims, 23 Drawing Sheets

Figure 10
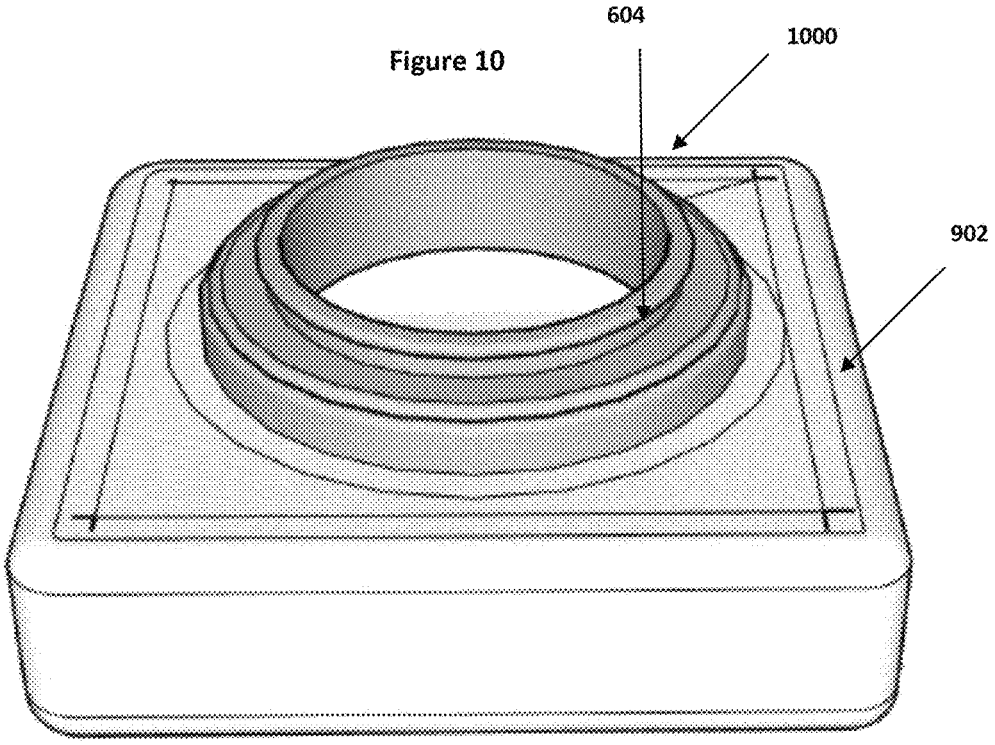
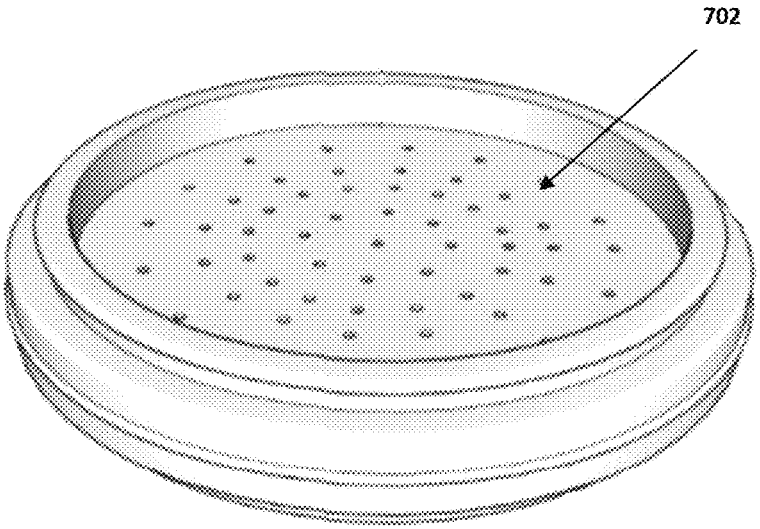
Figure 11

Figure 12
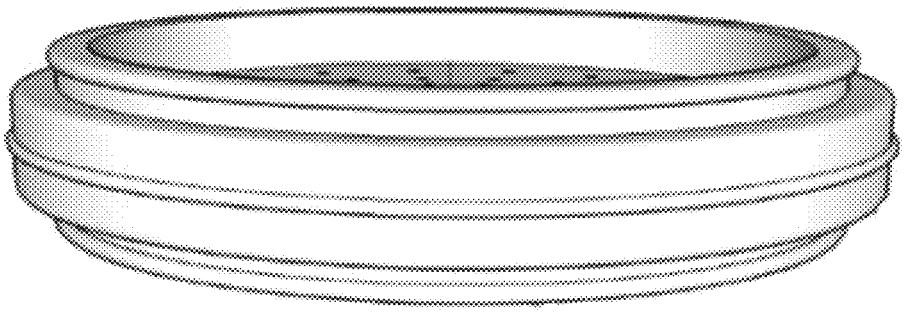
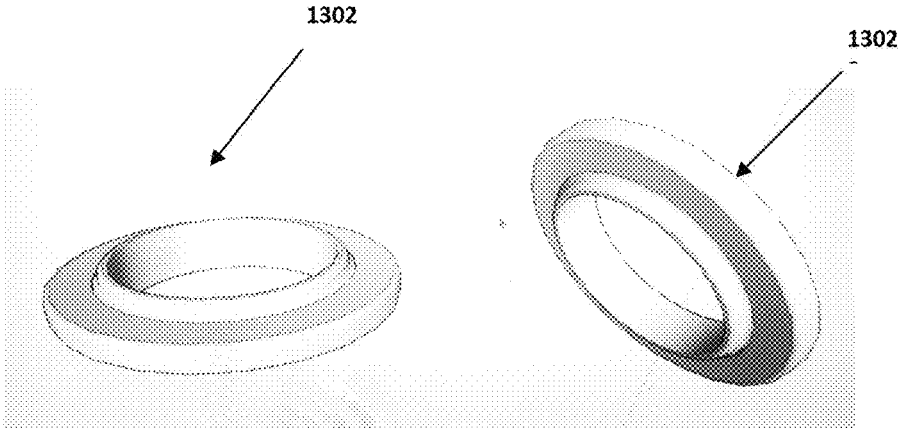
Figure 13 Figure 14

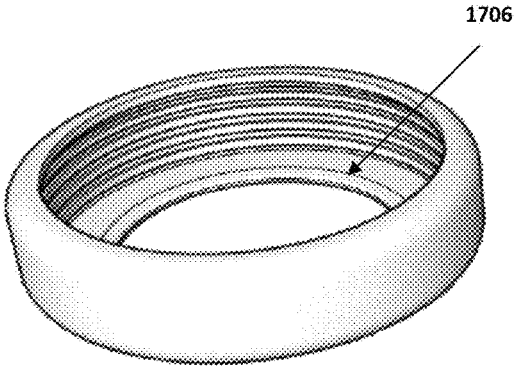
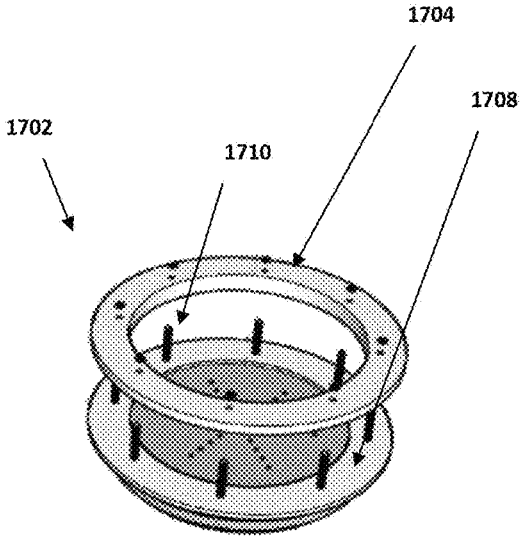
Figure 17
Figure 18
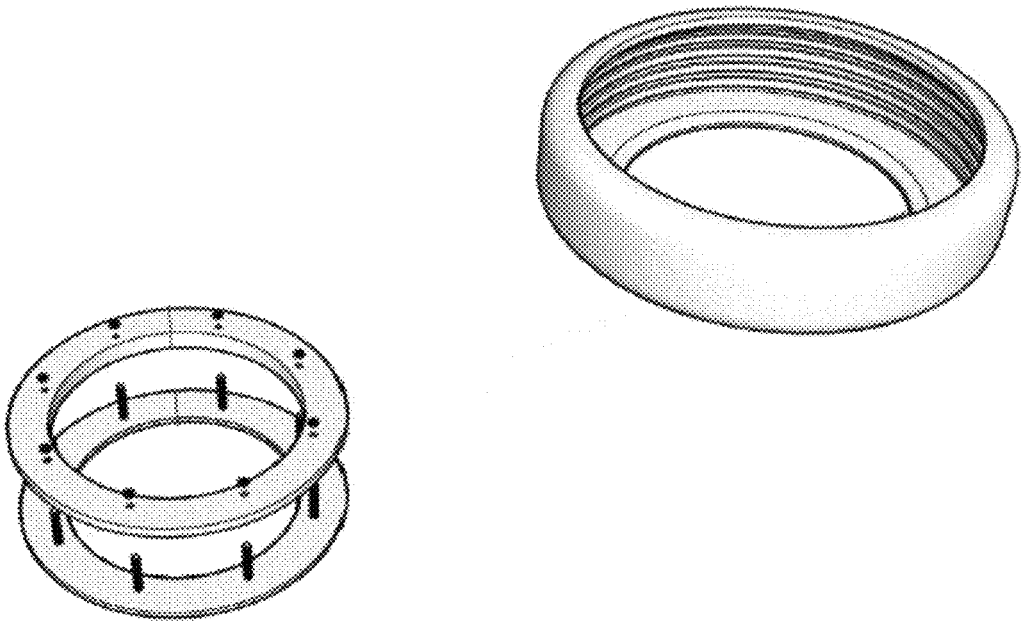

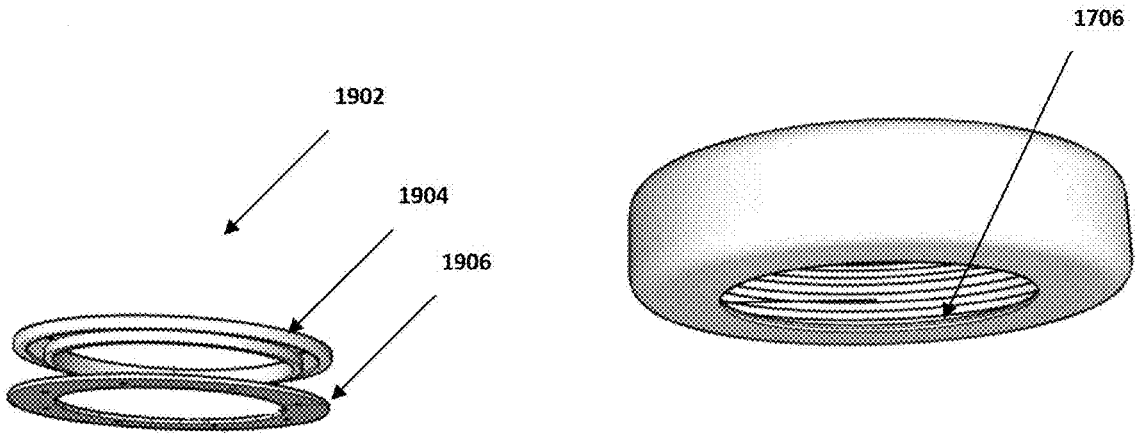
Figure 19
Figure 20
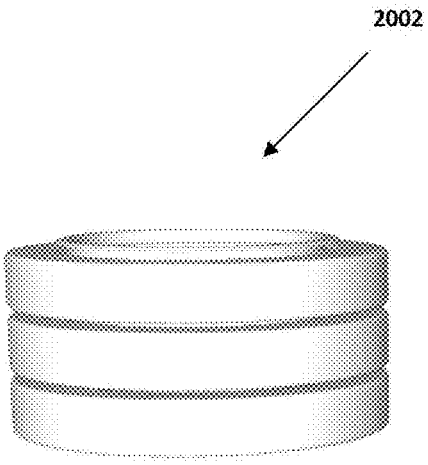
Figure 21
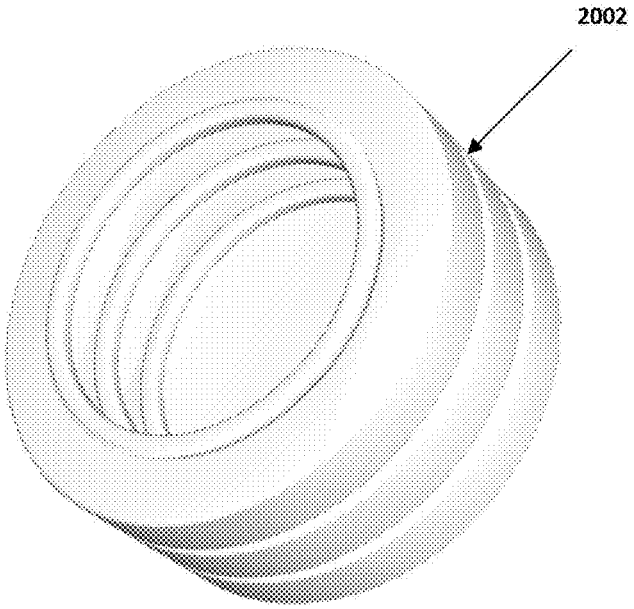

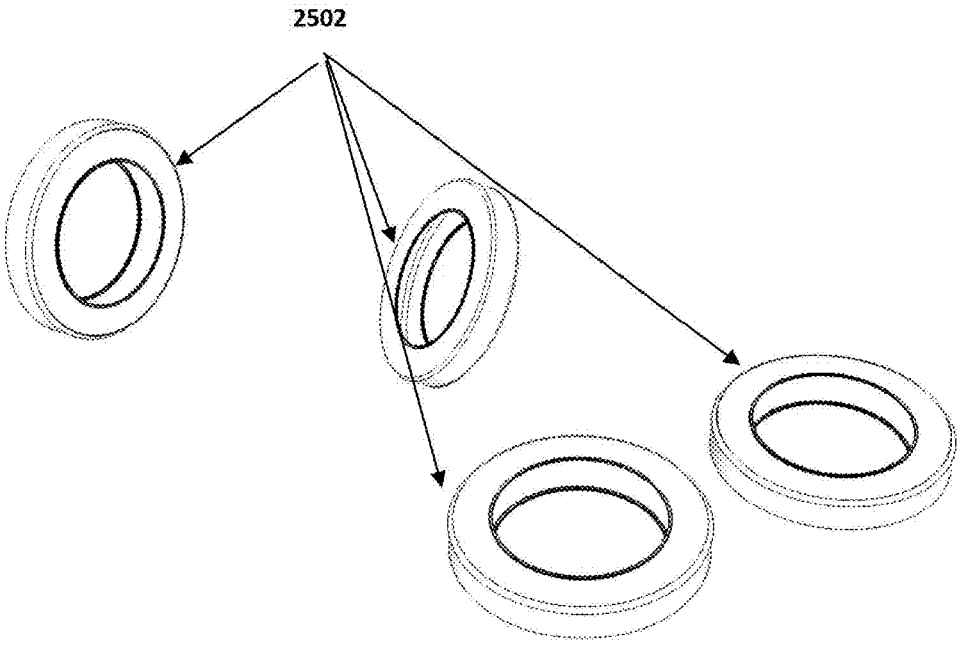
Figure 26
Figure 27
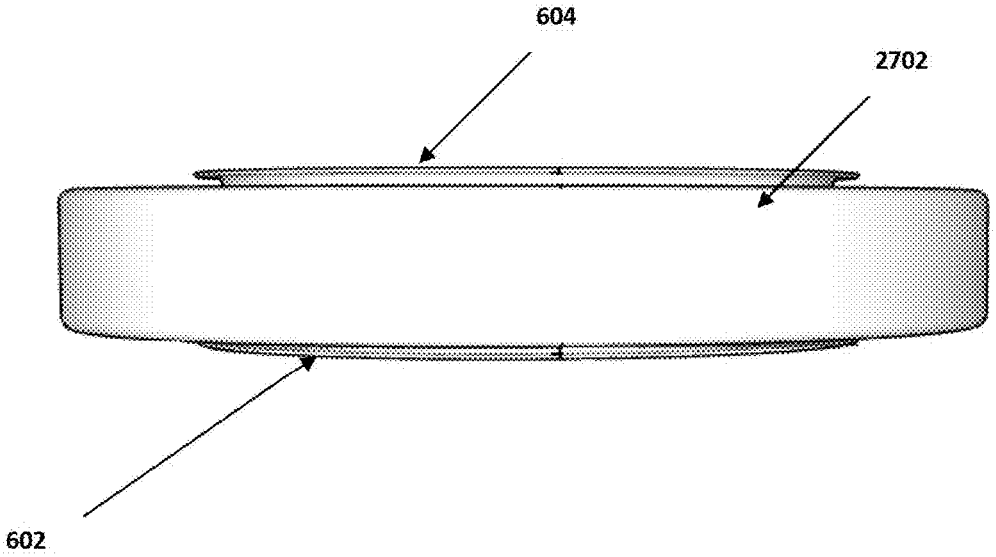

TIRE INTERCONNECT ADAPTER AND SYSTEM

CROSS-REFERENCE TO RELATED APPLICATIONS

This application is a divisional of pending U.S. patent application Ser. No. 18/136,900 titled "Tire Stacking Adapter", filed on Apr. 20, 2023, the disclosure of which is herein incorporated by reference in its entirety.

PATENTS CITED

The following documents and references are incorporated by reference in their entirety, Sun (U.S. Pat. No. 8,211,306).

FIELD OF THE INVENTION

The invention relates to tire interconnect adapter, and specifically to a tire coupling mechanism that allows for the construction of structures using waste or used vehicle tires, including specifically fluid tanks.

DESCRIPTION OF THE RELATED ART

Worldwide, there is a significant problem with used or waste vehicle tires. Made to be durable from multi-ply materials including steel, rubber and others, vehicle tires are made to survive heat, cold, Ultra violet radiation, conditions that regularly destroy other materials. While some suggest the shredding of the materials for playgrounds, serious concerns remain.

What is needed, particularly in the developing world, is a way to construct useful structures such as fluid storage tanks, using those same used tires.

SUMMARY OF THE INVENTION

This section is for the purpose of summarizing some aspects of the present invention and to briefly introduce some embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e., that it will be taken to mean an inclusion of not only the listed components it directly references, but also other non-specified components or elements. This rationale will also be used when the term 'comprised' or 'comprising' is used in relation to one or more steps in a method or process.

In one aspect, the invention is about a tire interconnect adapter comprising: a hollow central body comprised of a first top half and a second bottom half that are mechanically enjoined, wherein said first upper half has tire attachment and sealing mechanical components shaped so as to completely create a mechanical and pneumatic seal around the external rim of a vehicle tire; and wherein said second bottom half has tire attachment and sealing mechanical components shaped so as to completely create a mechanical and pneumatic seal around the external rim of a vehicle tire.

In another aspect, said first top half and said second bottom half are enjoined through one or more of the following techniques: single piece casting, single piece machining, screw-on, Snap-On or chemical bonding; and said first top half and said bottom half tire attachment and sealing mechanical components is accomplished through one or more of the following techniques: complementary shaped rim edge pressure, two rings secured to each other via screws/nuts, Snap-On clamps, screw-on clamps, compression clamps, silicone beads, glue, O-rings, gaskets.

In one aspect the invention is about a fluid tank system comprised of: a base adapter having a sealed tank body and a top that has a tire attachment and sealing mechanical components shaped so as to completely create a mechanical and pneumatic seal around the external rim of a vehicle tire, one or more vehicle tires, one or more a tire interconnect adapters, each adapter comprising: a hollow central body comprised of a first top half and a second bottom half that are mechanically enjoined, wherein said first upper half has tire attachment and sealing mechanical components shaped so as to completely create a mechanical and pneumatic seal around the external rim of a vehicle tire; and wherein said second bottom half has tire attachment and sealing mechanical components shaped so as to completely create a mechanical and pneumatic seal around the external rim of a vehicle tire; and a lid on top of the highest adapter opening.

In another aspect, said first top half and said second bottom half are enjoined through one or more of the following techniques: single piece casting, single piece machining, screw-on, Snap-On or chemical bonding; and said first top half and said bottom half tire attachment and sealing mechanical components is accomplished through one or more of the following techniques: complementary shaped rim edge pressure, two rings secured to each other via screws/nuts, Snap-On clamps, screw-on clamps, compression clamps, silicone beads, glue, O-rings, gaskets.

Other features and advantages of the present invention will become apparent upon examining the following detailed description of an embodiment thereof, taken in conjunction with the attached drawings, which are provided for purposes of illustration and not of limitation.

BRIEF DESCRIPTION OF THE DRAWINGS

FIG. 10 shows a proposed bottom tire interconnect adapter s with surrounding support, according to an exemplary embodiment of the invention.

FIG. 11 shows a perspective view of a proposed tire interconnect adapter with built in strainer, according to an exemplary embodiment of the invention.

FIG. 12 shows a front view of a proposed tire interconnect adapter with built in strainer, according to an exemplary embodiment of the invention.

FIGS. 13-14 show proposed bottom tire interconnect adapters, according to exemplary embodiments of the invention.

FIGS. 17-19 show proposed tire interconnect adapters next to a tire, according to exemplary embodiments of the invention.

FIGS. 20-21 show proposed tire interconnect adapters joining three tires, according to exemplary embodiments of the invention.

FIG. 26 shows various perspectives of proposed internal tire liner mechanisms, according to an exemplary embodiment of the invention.

FIGS. 27-28 show proposed tire interconnect adapters, according to exemplary embodiments of the invention.

Figure 1:
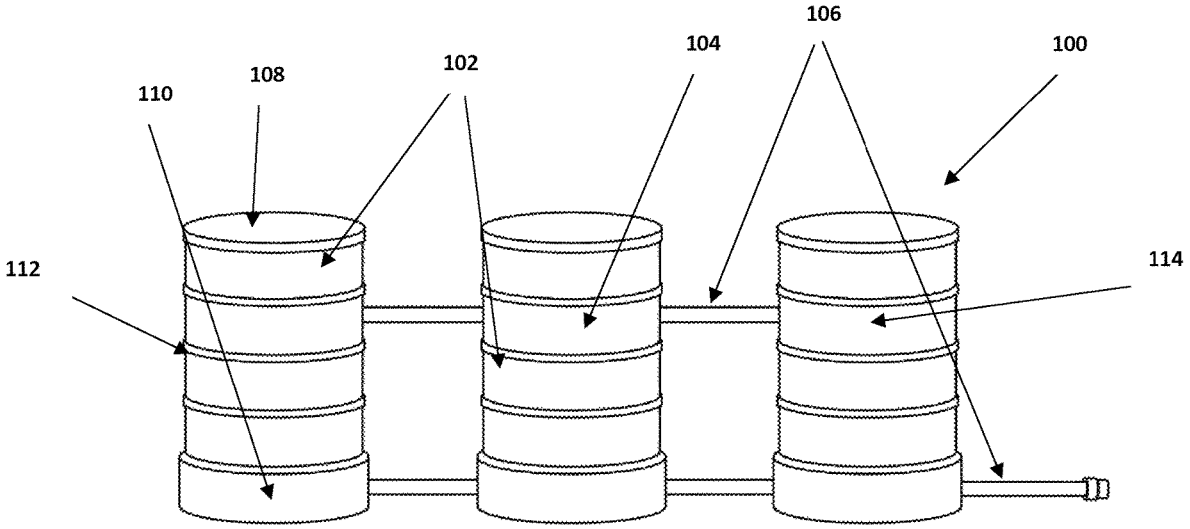
FIG. 1 shows a front view of a proposed fluid tank using the proposed tire interconnect adapter, according to an exemplary embodiment of the invention.

The above-described and other features will be appreciated and understood by those skilled in the art from the following detailed description and drawings.

DETAILED DESCRIPTION OF THE INVENTION

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

Figure 2:
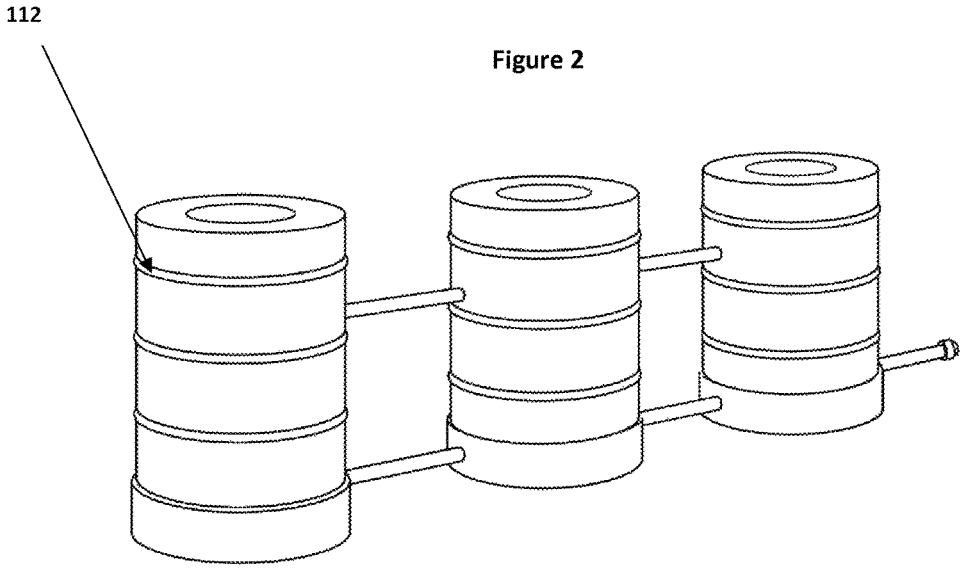
FIG. 2 shows a front perspective view of a proposed fluid tank using the proposed tire interconnect adapter, according to an exemplary embodiment of the invention.
Figure 3:
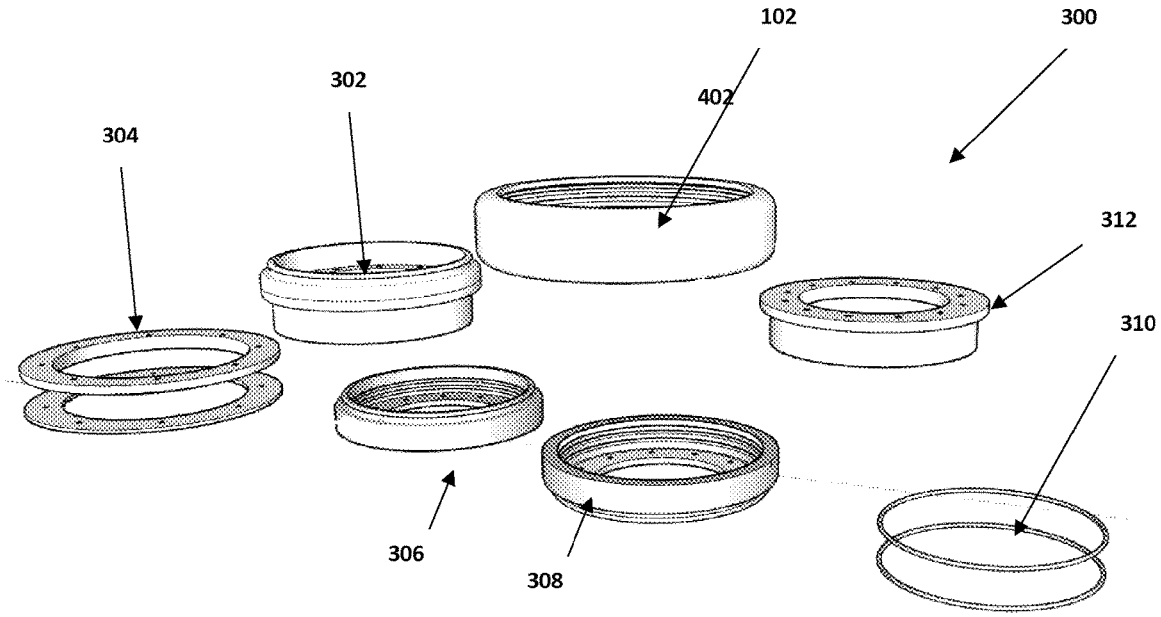
FIG. 3 shows various embodiments of the tire interconnect adapter components, according to an exemplary embodiment of the invention.

The value of the present Tire Interconnect Adapter and System (TIAS) or tire interconnect adapter can be seen in FIGS. 1-3, where we show an embodiment of a fluid storage system 100 that may be built using inexpensive vehicle tires 102, both new or used. The TIAS core is one of many couplers 200 designed to attach two vehicle tires 'rim to rim' so that the mechanically connected separate vehicle tires 102 become a continuous pneumatically and/or hydraulically interconnected volume stack 112, which then may be interconnected to stacks next to it via special coupling tire adapter 104. These volumes may be comprised of just one stack of tires/couples is used to create fluid tanks 100 mechanically linking two or more tires 102, which may be of different sized and/or rim size, through the use of varying adapters 300.

Figure 9:
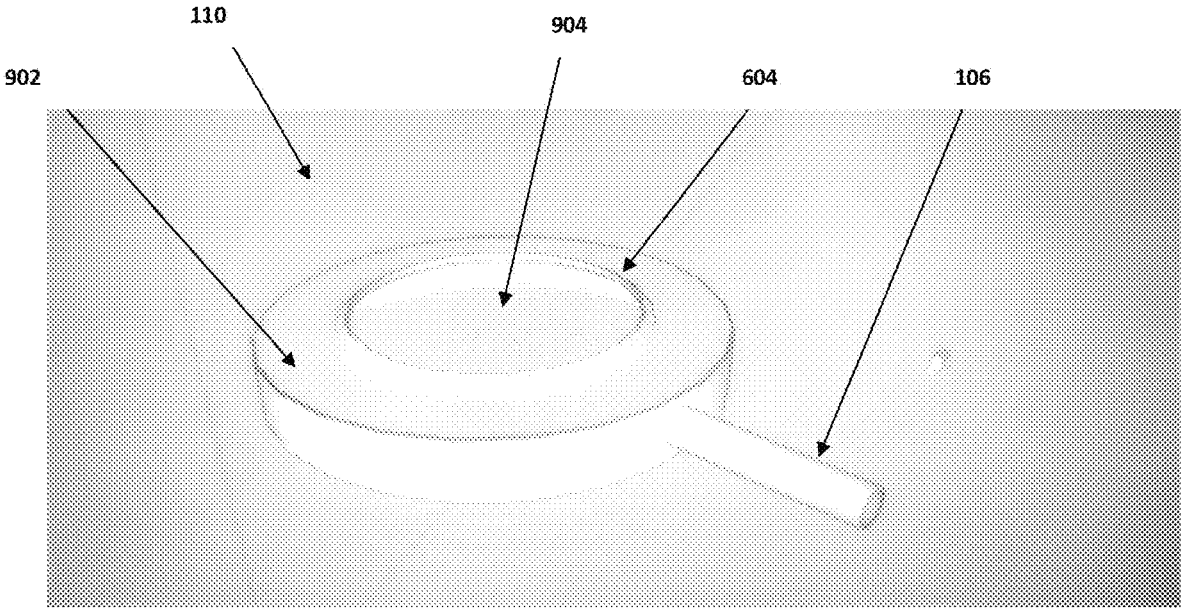
FIG. 9 shows a perspective view of a proposed tank/pipe connector tire interconnect adapter, according to an exemplary embodiment of the invention.
Figure 15:
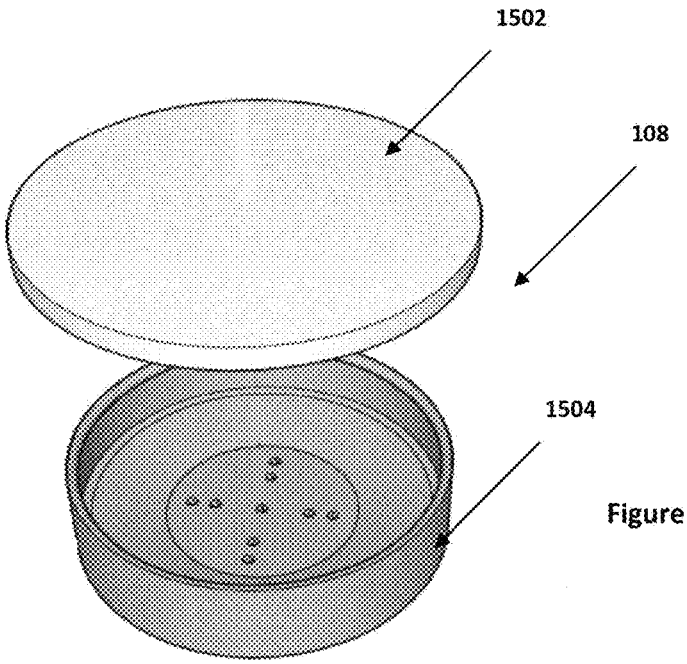
FIGS. 15-16 show bottom tire interconnect adapters with surrounding support, according to exemplary embodiments of the invention.
Figure 16:
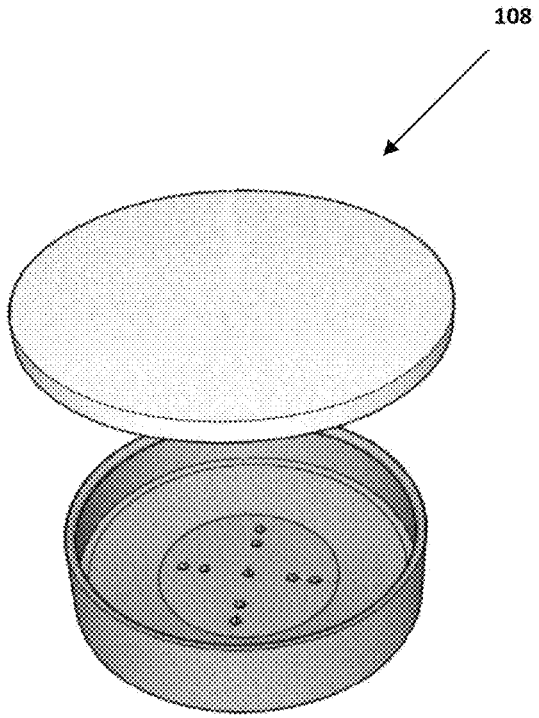
Figure 22:
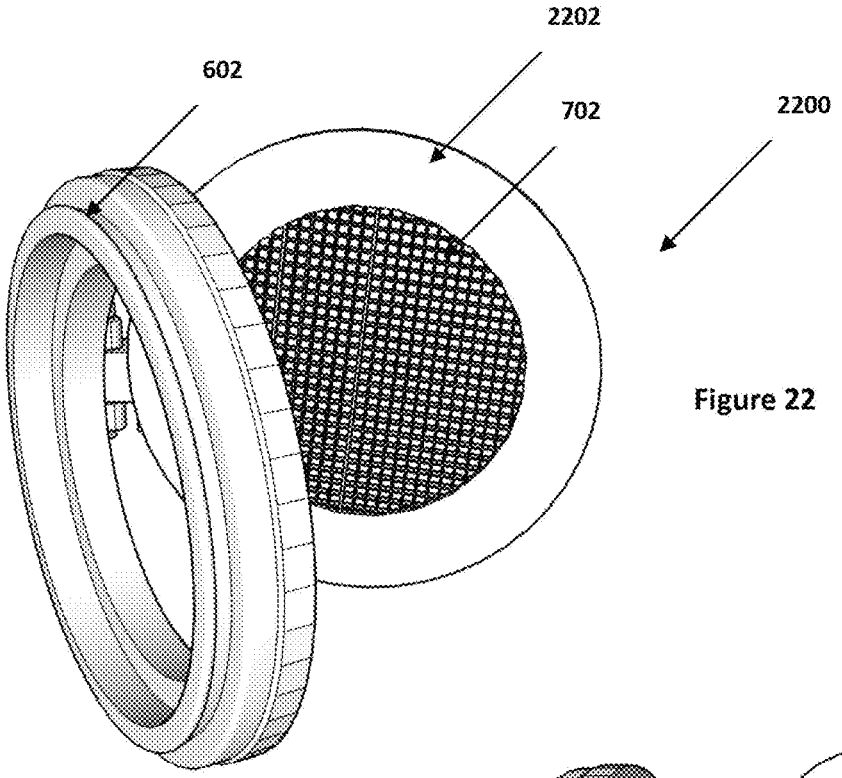
FIGS. 22-23 show proposed tire interconnect adapters top units, according to exemplary embodiments of the invention.
Figure 23:
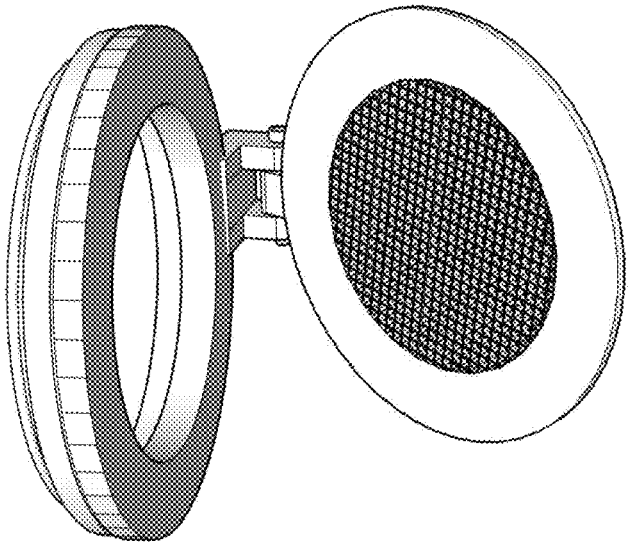

The tire stacks or tanks 112 can then be assembled in-situ by low skilled labor, by starting with a base adapter 110 (FIG. 9). This base 110 is comprised of a sealed tank 902 having a with a top opening 904, an outlet pipe/spigot 106 and a special adapter rim 604 around the opening 904 so it meets and seals the same way as the top rim 604 of the adapter 104. An alternate base 1000 (FIG. 10) may be square 902. In another embodiment, the tank 110 has openings on top and bottom 114 so it may be placed along the stack 112. As with the regular adapters 104, the seal of the tire 102 rim to adapter rim 604 may be mechanical, chemical, force, clamps, etc.

In this way, the worker assembling a tank 100, simply stacks the tire on top of the base 110, then clamps it (having a convenient opening, in case they want to use mechanical clamps 3200, 3300 or 3500.

After the first connection, the other (now top) part of the tire is connected to an adapter then interspacing tires and adapters (perhaps using intermediate faucets/pipes 106) simply inserting, in one embodiment, an adapter 104 into the tire bead area (where the wheel rim usually seals the connection. In other embodiments, the base may be set on a table or other supporting structure.

In one embodiment, the adapter's 104 rim 602/604 shape is complementary or the reverse of a regular vehicle tire rim, so by 'mounting' the edge of the tire into the rim 906 (just like when a tire is mounted to a rim, by forcing the edge of the tire over the edge of the adapter rim 602/603), the tire 'lip' will be held down and sealed through the shape of the adapter rim 602/604. In another embodiments (FIGS. 3 and 17-19), the adapter 1702 is made of two rings 1704/1708 that squeeze the tire rim 1706 and seal to it as the screws 1710 around them are tightened (On each side 602/604), or two Snap-On facets 304, or screw on facets 306/308 secured either by rotation of one facet 306 against the other 308 or by screw-on clamps 3200, or compression clamps 3206 or a single sided adapter 302/312, or again two 1704/1708 on each side).

The compression tool (FIGS. 33-38) allows for the easy compression of the clamps 3206, through a manual, electric or battery-powered pump 3302, hose 3304, powered clamp 3306 that compresses the clamp 3206.

An important advantage of the 1704/1708/1710 adapter, is that it allows for the creation of the sealed joint gradually as the tires are stacked on top of each other in the field. Similarly, the tire rim to adapter rim seal may be accomplished by chemical means (e.g., glue, O-ring, gaskets, Silicone or similar beads, etc.).

In addition, 3400 to the O-ring (FIG. 34), special foam, rubber, plastic pads 3402 may be added to either the internal or external edges of the adapter 104 rims 602/604 so that the joints may be insulated or the interior of the chambers (where the fluid resides) is insulated from the outside. The pads may also be comprised of two or more materials 3404. These pads allow for both temperature, vibration and sound insulation, and may be also made from flame retardant materials.

Note that in one embodiment 600, the adapter 104 is casted, machined, additively manufactured (e.g., 3D printing) or molded from a single piece. In another embodiment, the adapter 104 is comprised of two halves, one having the top rim adapter 604, the other the bottom rim adapter 602 split along the center axis 606, that are enjoined by either screwing them on to each other 306/308, snapping to each other 302/312, etc. So, you simply install the rims 602/604 to the tires separately, then enjoin them with the tires attached.

Figure 4:
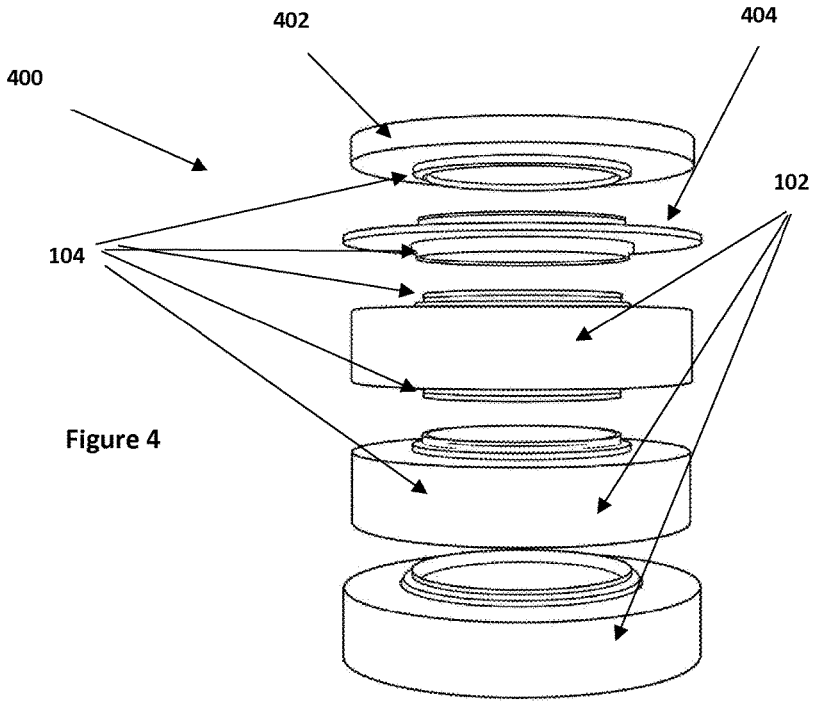
FIG. 4 shows a front view of a tire stack using the tire interconnect adapter, according to an exemplary embodiment of the invention.
Figure 5:
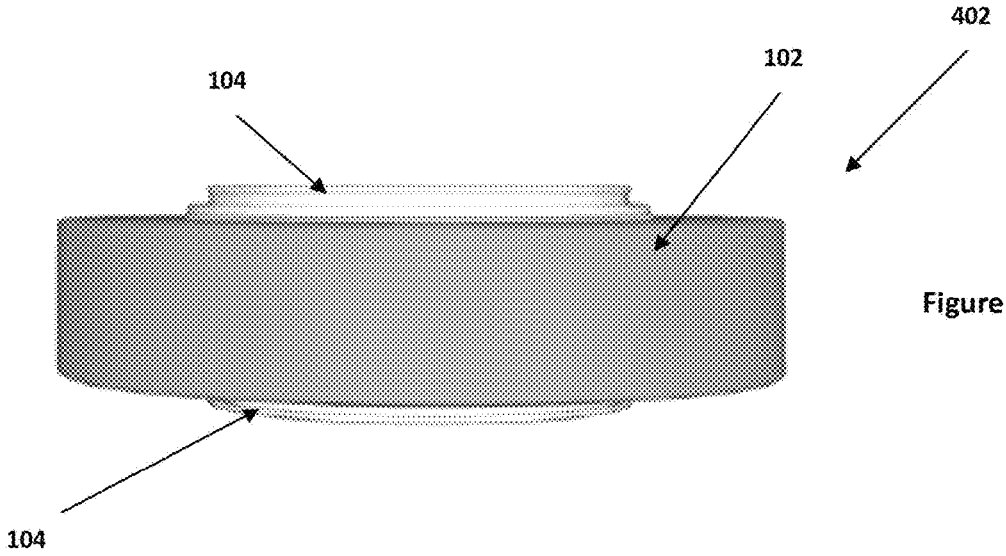
FIG. 5 shows a front view of a tire with the proposed tire interconnect adapter connected to the top and bottom of a tire, according to an exemplary embodiment of the invention.
Figure 6:
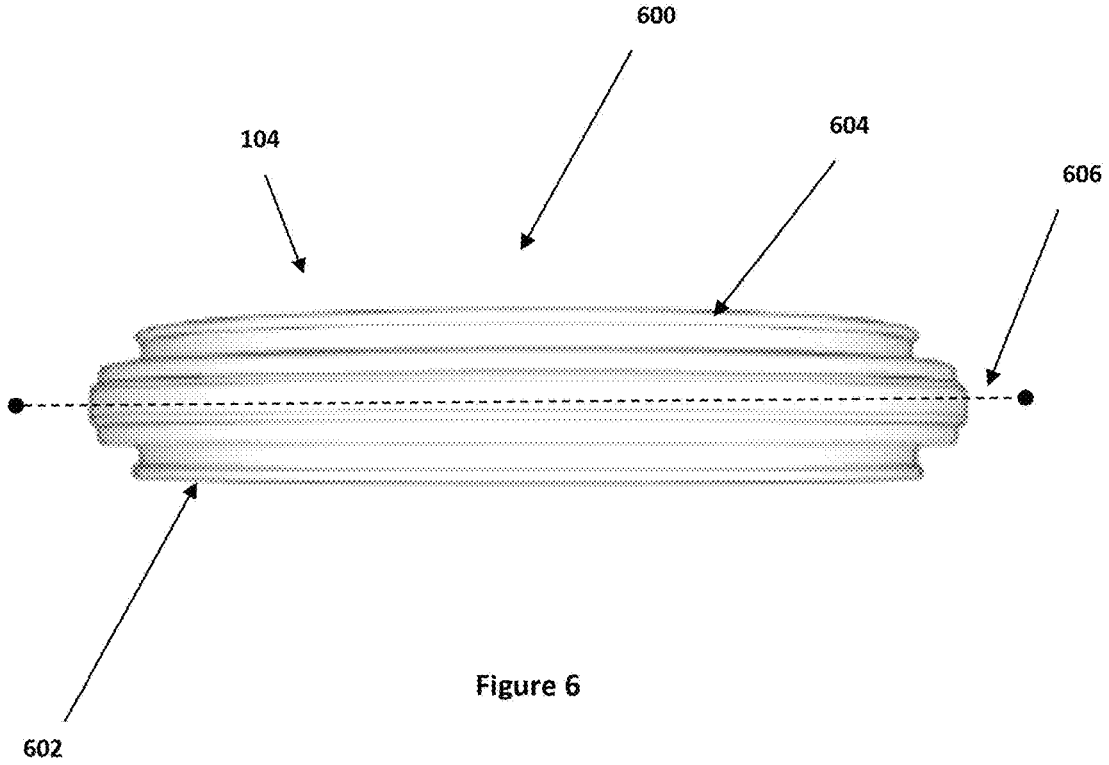
FIG. 6 shows a front view of a proposed tire interconnect adapter, according to an exemplary embodiment of the invention.
Figure 7:
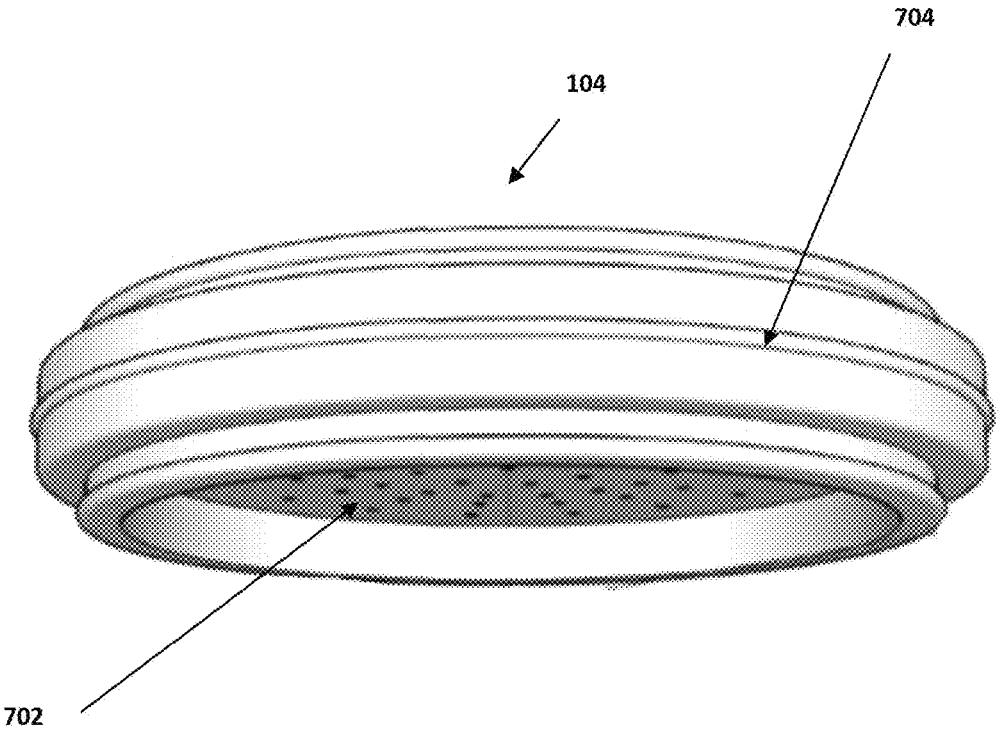
FIG. 7 shows a bottom front view of a proposed tire interconnect adapter, according to an exemplary embodiment of the invention.
Figure 8:
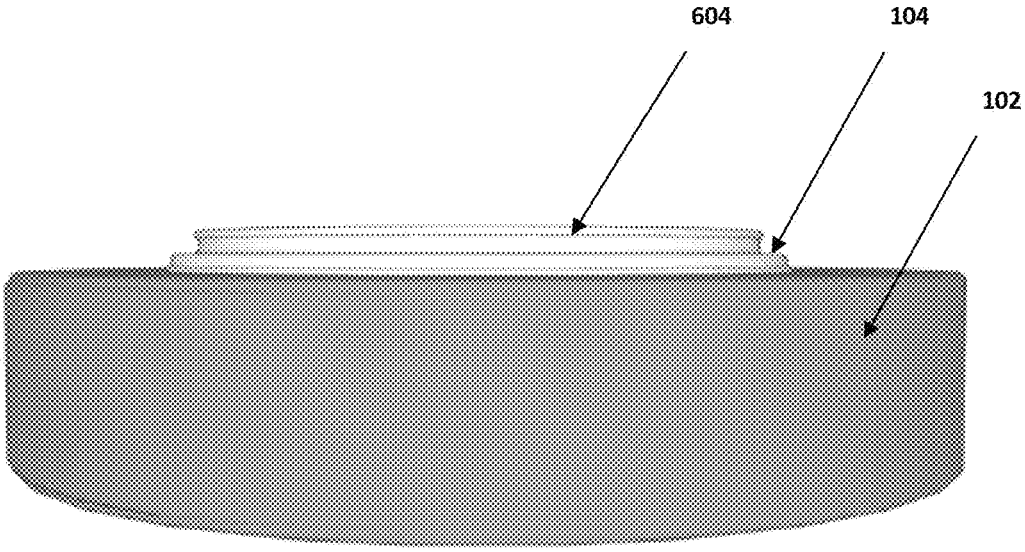
FIG. 8 shows a front view of a proposed tire interconnect adapter on top of a tire, according to an exemplary embodiment of the invention.

In effect (FIGS. 4-6), the tire rim 1706 of the lowest tire 102 is capture by the rim adapter of the base adapter 106, and the upper rim of said tire is then capture by the lower rim 602 of the adapter 104. Another 104 tire is then placed above the adapter 104, and the lower rim of the tire 1706 capture by the upper rim 604 of the adapter, resulting in the tire 102 having an adapter on the bottom and another on the top 400.

Other adapters 400 may have special interfacing surfaces 402, 404 or extensions to the adapter width 104, around the middle of the main adapter 104 so that two tires or other pieces when resting won't topple over. In particular, 402/404 may help when the width of the tires does not match, potentially leading to tires toppling over. By keeping the inside of the adapter 104 either open or perforated 702, the flow of the fluid within the tank can be controlled. By creating a tight seal around the tire bead (also known as the tire rim), a continuous sealed 'vessel' is created.

In yet another embodiment, the adapter 104 is a solid structure 2702 with external dimensions that match that of the tires', so that the stack has no gaps and the tires solidly resting on the sides of the adapter 2702. Similarly (FIG. 36), the adapter 104 is formed from two half 3602/3604 that are screwed on together, so that the complementary lips 3614/3616 form the piece that holds the seal around the rim of the tire once the two halves 3612 screw onto each other on the complementary thread 3608.

The top 3606 may be solid or with more openings, as well as a mechanical openings to help the turning of one half against the other. The openings 3610 interconnect the volume of the tires. Optional O-rings 310 help seal the joint, or silicone/glue/chemical beads may be used. An optional path/plug 3618 would allow for the entry of air, foam, polyurethane or other material when the combined adapter 104, tire 102 is used as a wall.

Figure 24:
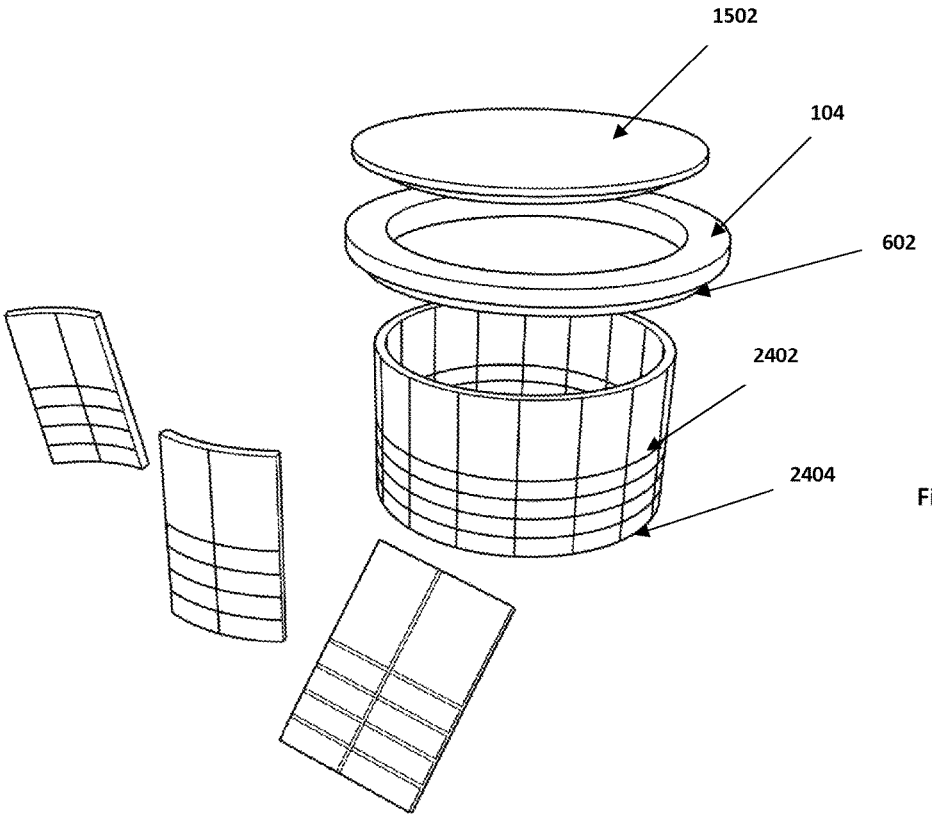
FIG. 24 shows a perspective front view of a proposed tire interconnect adapter with built in support tube, according to an exemplary embodiment of the invention.
Figure 25:
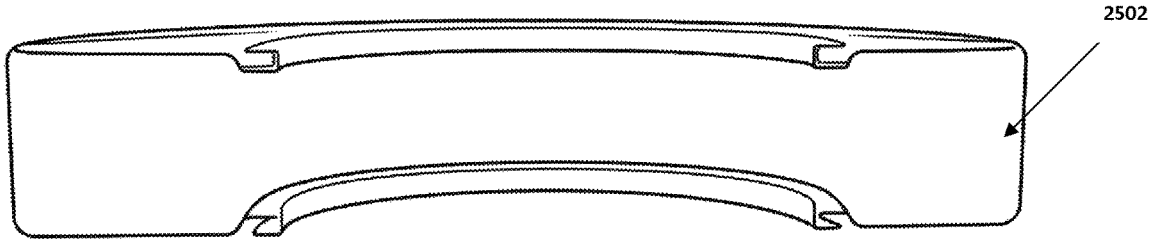
FIG. 25 shows a perspective front view of a proposed internal tire liner adapter, according to an exemplary embodiment of the invention.
Figure 28:
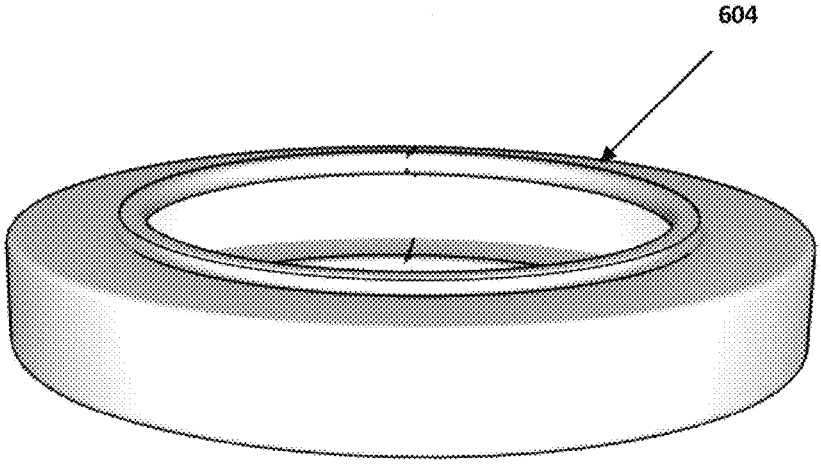
Figure 29:
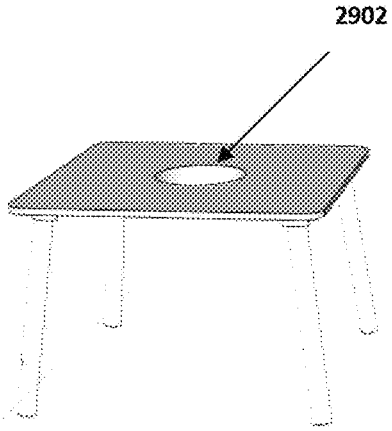
FIGS. 29-30 show proposed tables to host tires on them, having a tire interconnect adapters on top of the table surface, according to exemplary embodiments of the invention.
Figure 30:
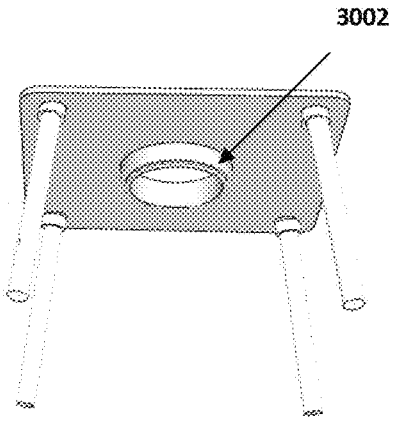
Figure 31:
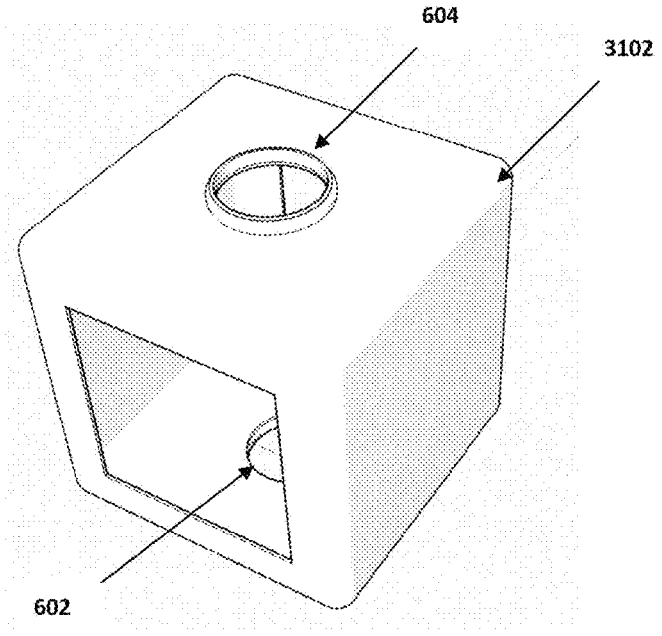
FIG. 31 shows a perspective front view of a proposed animal pen intended to have tire interconnect adapters on top and/or bottom, according to an exemplary embodiment of the invention.
Figure 32:
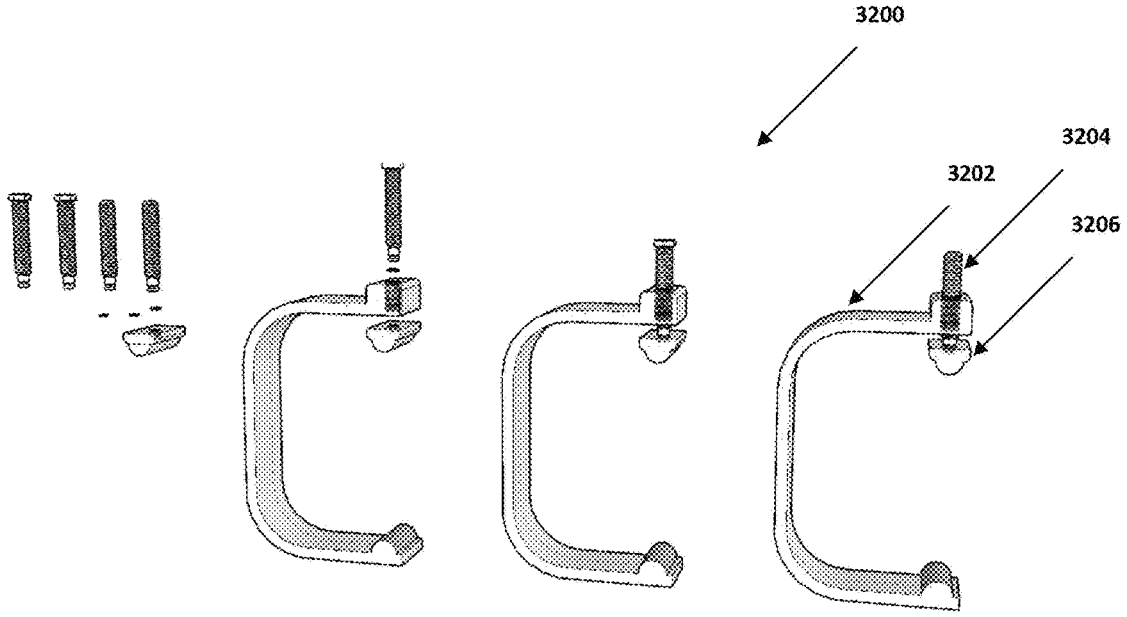
FIG. 32 shows a perspective view of proposed screw-on clamps to seal the tire rim to the adapter's rim, according to an exemplary embodiment of the invention.
Figure 33:
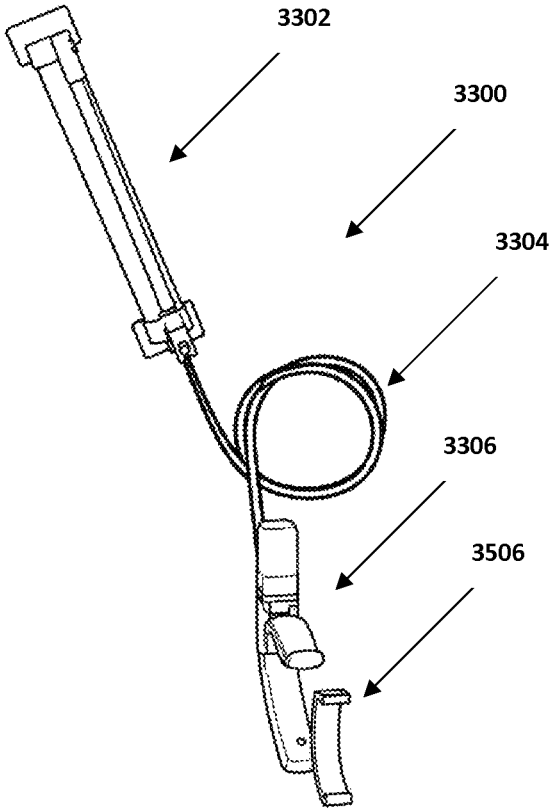
FIGS. 33 and 39 show perspective views of a proposed pressure clamp and tool to seal the tire rim to the adapter's rim, according to an exemplary embodiment of the invention.
Figure 34:
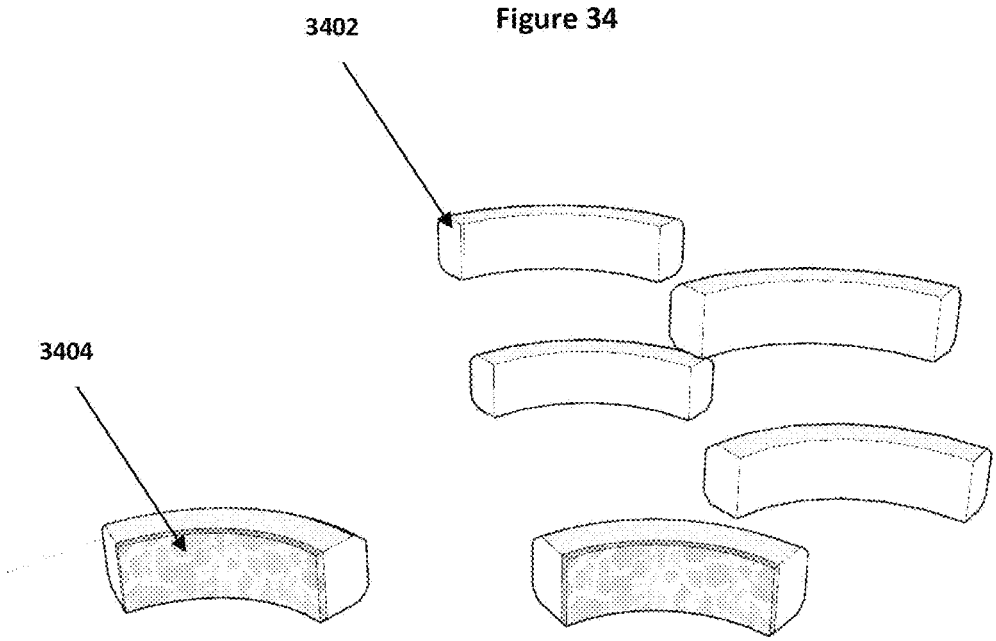
FIG. 34 shows a perspective view of sealing and insulation gaskets to seal the tire rim to the adapter's rim and help with insulation, according to an exemplary embodiment of the invention.
Figure 35:
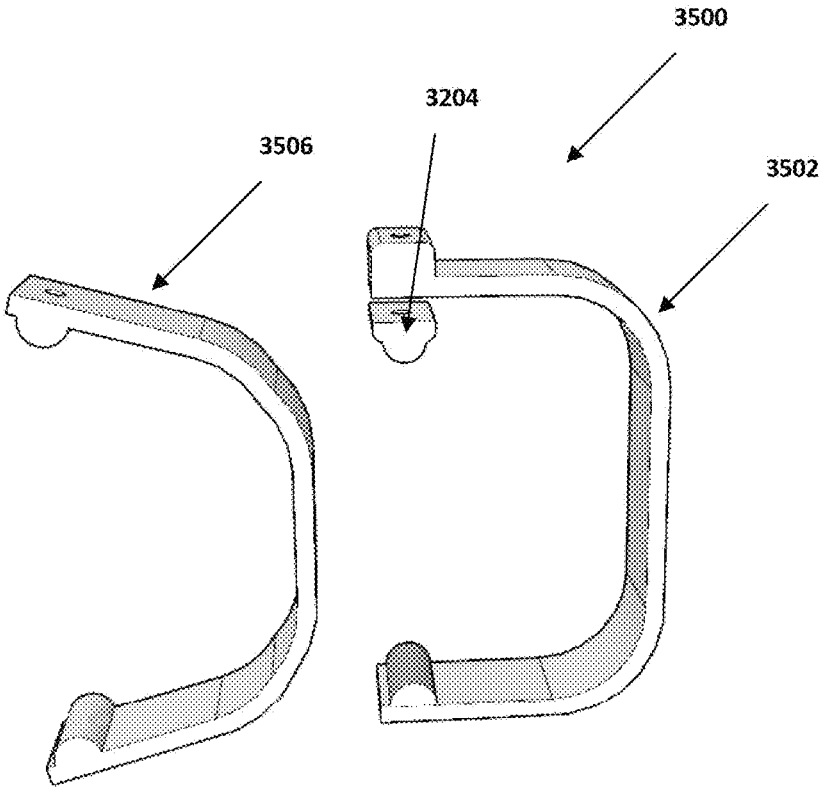
FIG. 35 shows a perspective view of proposed pressure clamps to seal the tire rim to the adapter's rim, according to an exemplary embodiment of the invention.
Figure 36:
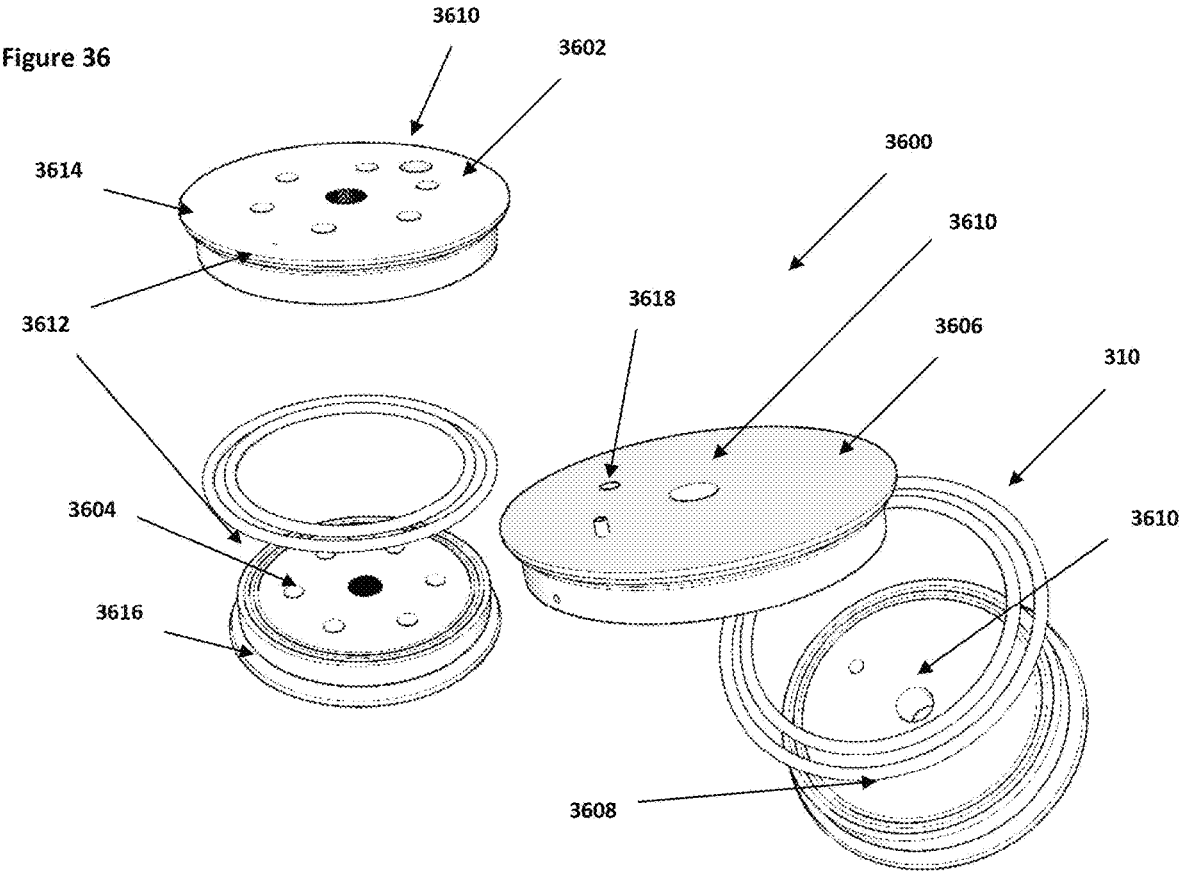
FIGS. 36 and 40 show proposed tire interconnect adapters comprised of an upper and a lower half, according to exemplary embodiments of the invention.
Figure 40:
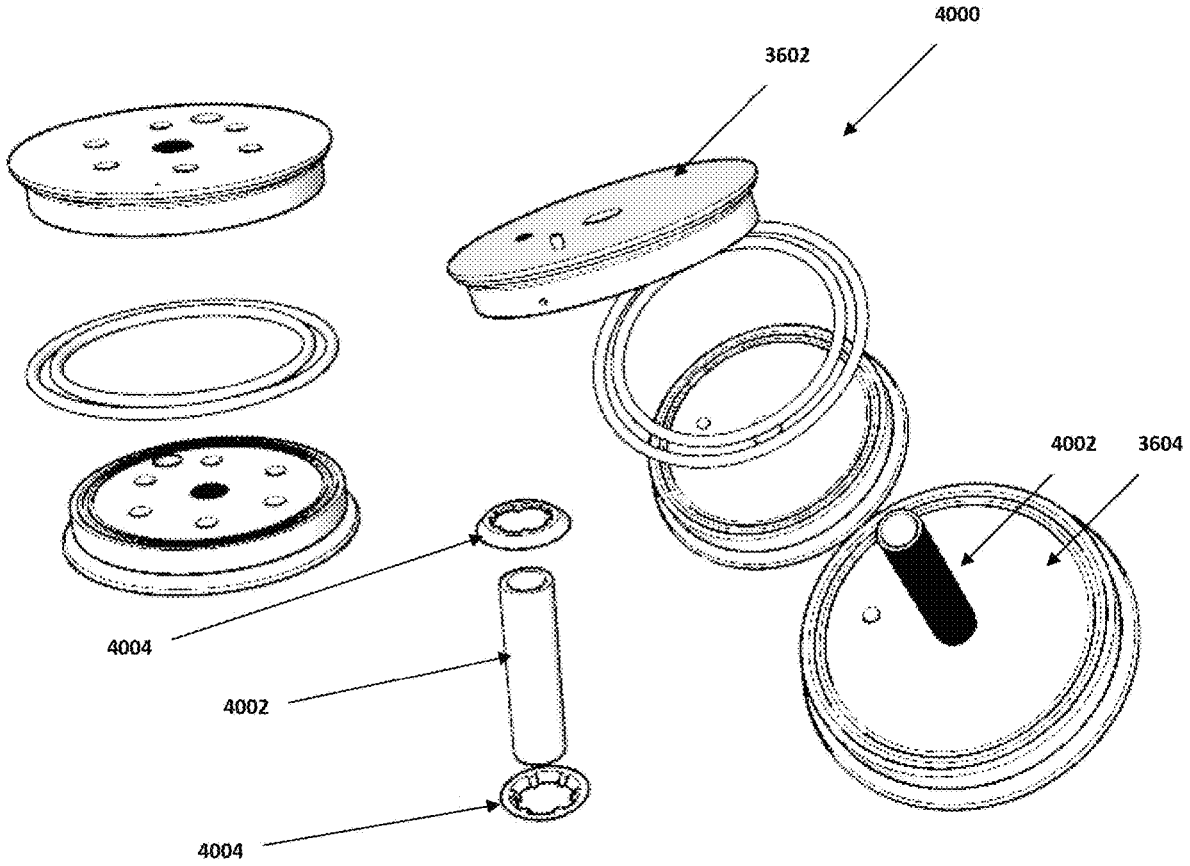
Figure 41:
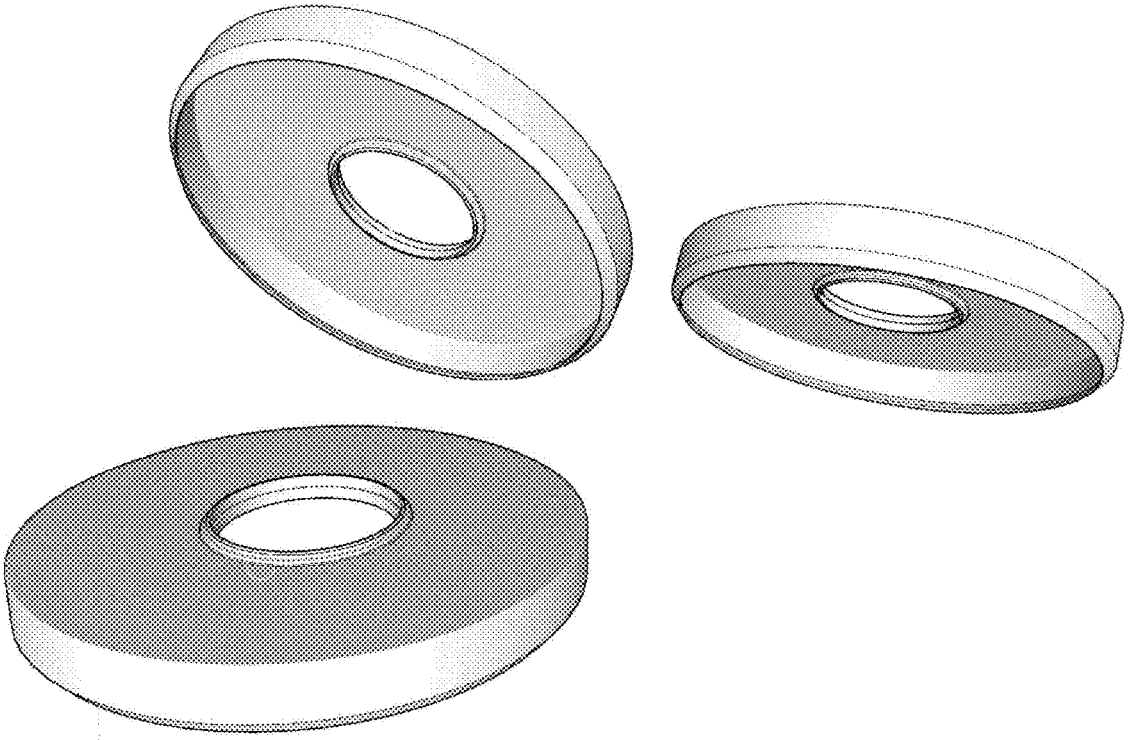
FIG. 41 shows a perspective view of proposed cover to prevent iguanas and other animals from entering the assembly, according to an exemplary embodiment of the invention.
Figure 42:
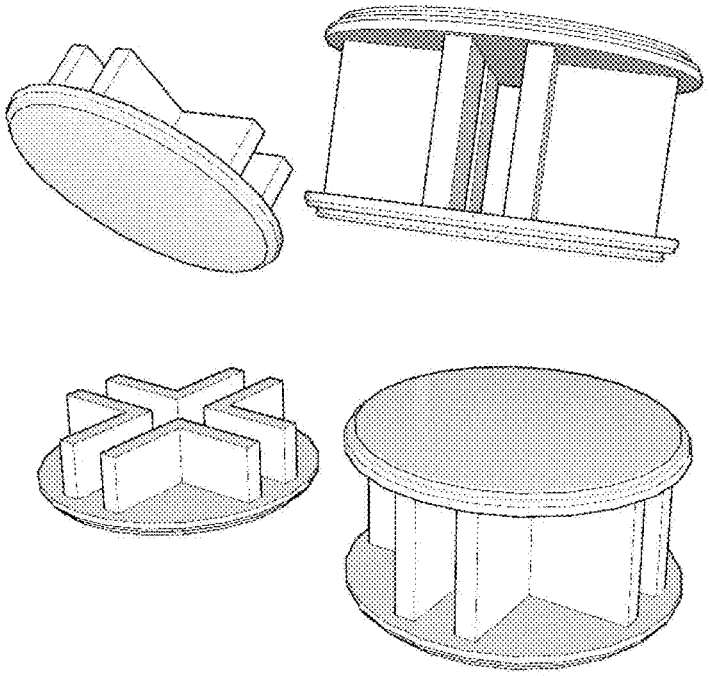

In one embodiment (FIG. 40), there is a tube 4002 that is clamped/screwed 4004 at each end, so that when inserted between the two halves 4000, the required tension between the two halves 3602/3604 is preserved. In a similar embodiment, a built-in hub 2402 may simply extend from such a top (FIG. 24) to the bottom, allowing for the weight of the structure above it to be transferred. Since the exact height of the tire is not precise, different striations 2404 are built into the hub 2042, so it becomes easy for workers in the field to adjust the height of the piece.

By simply making the edges 602/604 match the structure of the screw on adapter 1702, the user stacks a base 108, places a tire on top, where the rim is of the again 602/604 or 1704/1708/1710 type, screws it on using the 1710 screws, places the bottom of another adapter 1702 on the top opening of the tire, screws them in, places the bottom of another tire atop the adapter, screws them on, successively.

In one embodiment (when functioning as a fluid tank), the top of the assembly is capped with a filter assembly 108 to allow fluid to come in while preventing bugs/mosquitos from entering or breeding within. Such an assembly may be a lid 1502 and filter 1504, or the built in top and adapter 2200, where the rim seal 602 and built in door 2202 with filter 702 are one.

This vessel may be filled with fluids (water, fertilizer mix, alcohol, etc.), or solids (dirt, earth), or even solidifying fluids (concrete, mortar, etc.), so that when filled, the stack 100 becomes a solid column. In another embodiment, the adapter 2200 is simply the top (rim 602 to meet with the top of the tire 102, so the lid 2202 snaps from the edge of the adapter 2200 and a screen 702 keeps mosquitos from growing.

A tire liner 2502 may be used as a prophylactic shield that would avoid the fluid inside from making direct contact with the tire inside. With a cross section defined by the expected tire dimensions, and perhaps 'tire tube' flexibility, such a device would inflate to fill in the tire volume inside the tire. Again, the rims may be tire tension ones 602/604, screw on 1704/1708/1710, screw-on 306/308, Snap-On (1904/1906), glue-on, etc.

Thanks to the adapter 104, a table 2902 may have similar stacks of tires 102 and adapters 104 either above 2902 or below them 3002. In a similar fashion, an enclosure 3102 may be created that has the adapters couplings on top 604 and/or bottom 602, creating an interconnected structure for chickens, rabbits or similar animals to reside while being interconnected.

Figure 37:
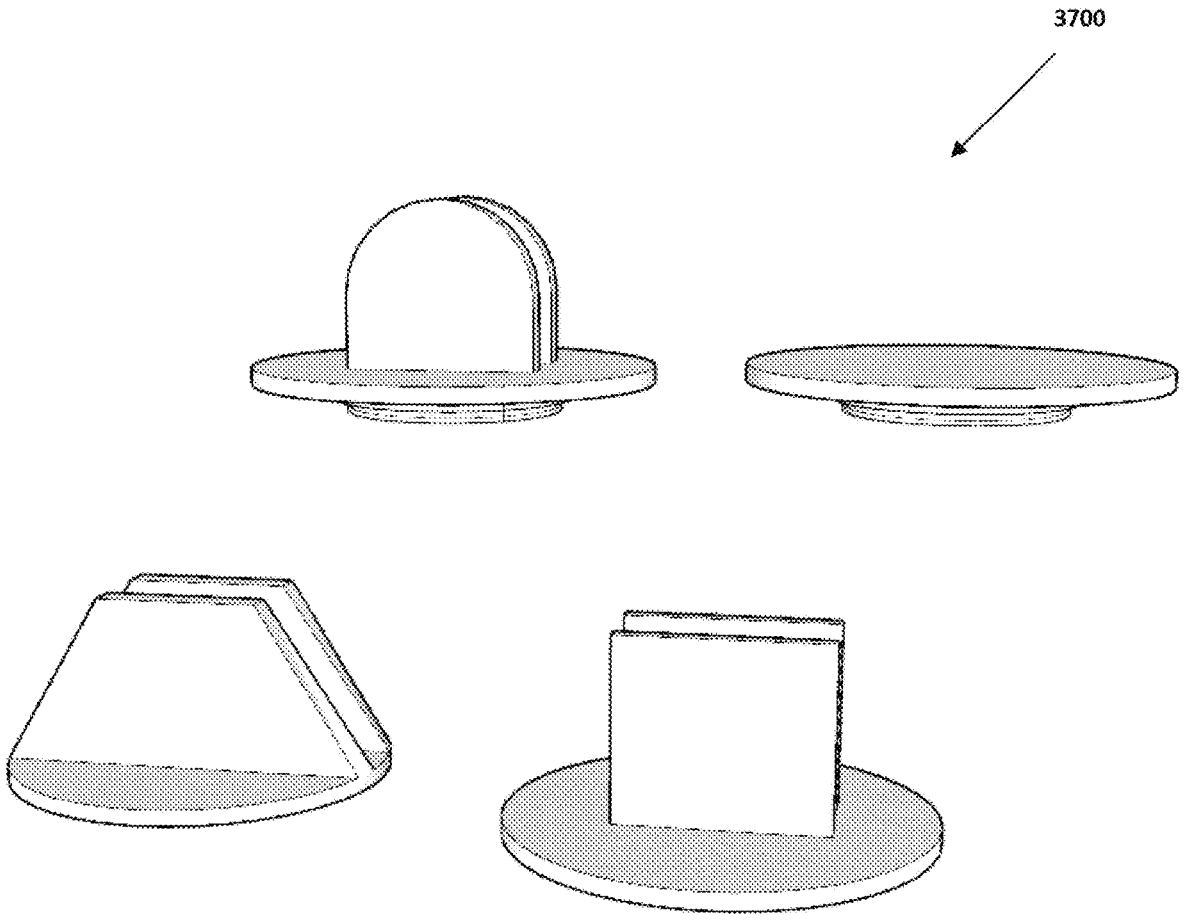
FIGS. 37 and 42 illustrate various adapters to facilitate construction with materials such as wood, plastic, metal, fiberglass, carbon fiber, according to an exemplary embodiment of the invention.
Figure 38:
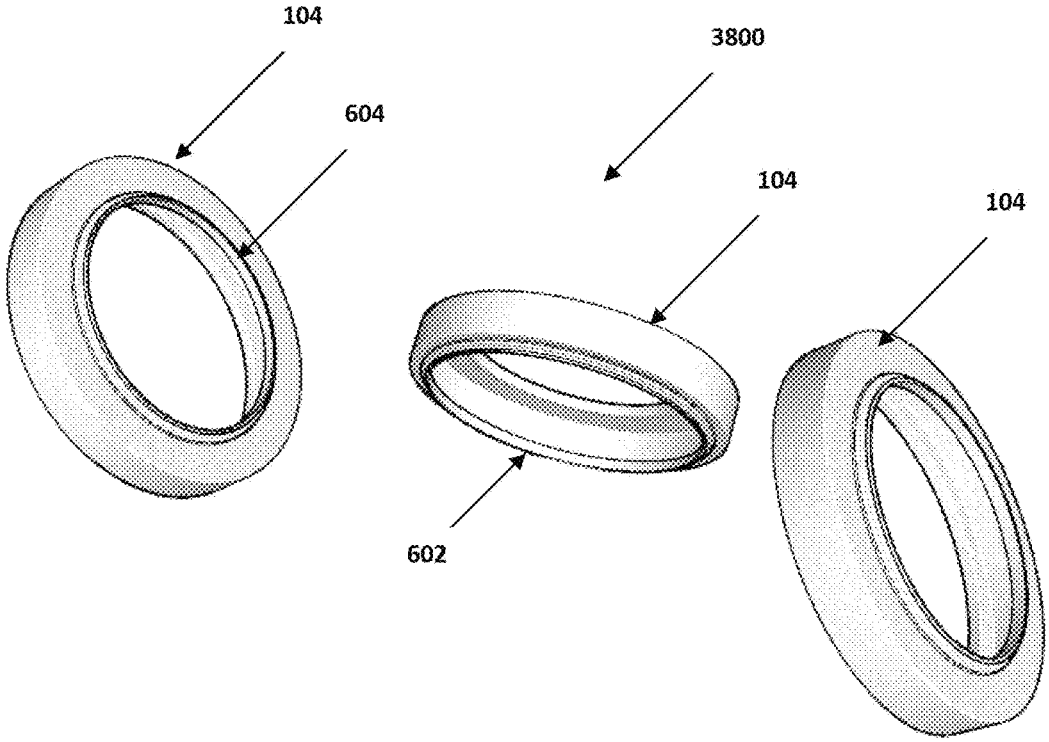
FIG. 38 shows a proposed tire interconnect adapter with different sized rims on each end, according to exemplary embodiments of the invention.
Figure 39:
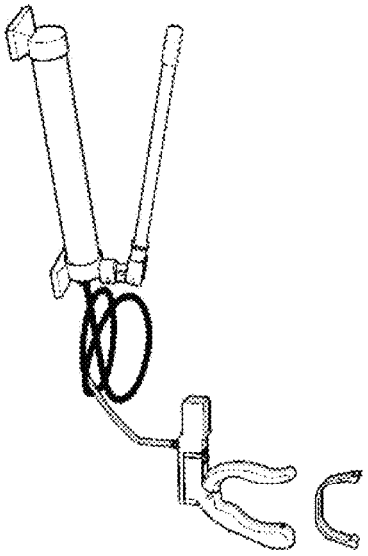

FIG. 37 illustrates 3700 various adapters to facilitate construction with materials such as wood, plastic, metal, fiberglass, carbon fiber, etc. By using these as interfaces to outside structures, the columns may be used as part of support structures for roofs, etc.

CONCLUSION

In concluding the detailed description, it should be noted that it would be obvious to those skilled in the art that many variations and modifications can be made to the shown embodiments without substantially departing from the principles of the present invention. Also, such variations and modifications are intended to be included herein within the scope of the present invention as set forth in the disclosure.

It should be emphasized that the above-described embodiments of the present invention, particularly any "exemplary embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention.

The invention claimed is:

1. A fluid tank system comprising:

a base adapter including a sealed tank body and an upper rim portion configured to form a fluid-tight seal with the rim of a vehicle tire;

one or more vehicle tires;

one or more a tire interconnect adapters, each said tire interconnect adapter comprising:

a hollow central body having an upper tire-engaging portion and a lower tire-engaging portion, wherein each tire-engaging portion includes a circumferential sealing surface configured to engage a bead region of a vehicle tire rim to form a fluid-tight seal; and wherein the upper tire-engaging portion and the lower tire-engaging portion are either integrally formed as a single unit or fixedly joined to one another;

wherein the base adapter, the one or more tire interconnect adapters, and the one or more vehicle tires cooperatively define a fluid-containing volume; and a lid on top of the highest tire rim opening.

2. The fluid tank system of claim 1 wherein:

the upper tire-engaging portion and the lower tire-engaging portion are formed as separate components and are fixedly joined by at least one of:

threaded engagement, fasteners, snap-fit engagement or adhesive bonding; and the circumferential sealing surface comprises at least one of:

a compressible gasket, an elastomeric O-ring, a sealing bead or opposed clamping surfaces configured to compress a tire bead.

3. The fluid tank system of claim 2 further comprising:

a flexible liner positioned within at least one of the vehicle tires to isolate stored fluid from an interior surface of the tire.

* * * * *